US005951247A

United States Patent [19]

Rockwell et al.

[11] Patent Number: 5,951,247

[45] Date of Patent: Sep. 14, 1999

[54] DISCHARGE VANES FOR AXIAL FANS

[75] Inventors: David M. Rockwell, Fayetteville; Sau-Tak R. Chou, Liverpool, both of N.Y.

[73] Assignee: Carrier Corporation, Syracuse, N.Y.

[21] Appl. No.: 08/980,197

[22] Filed: Nov. 28, 1997

[51] Int. Cl.[6] ..... F01D 1/04; F01D 25/24; F03D 3/04

[52] U.S. Cl. ..... 415/208.3; 415/211.1; 415/211.2; 415/208.3; 415/208.4; 415/223; 415/220

[58] Field of Search ..... 415/211.1, 211.2, 415/208.3, 208.4, 223, 220

[56] References Cited

U.S. PATENT DOCUMENTS

| | | | |
|---|---|---|---|
| 2,154,313 | 4/1939 | McMahan . | |
| 4,152,094 | 5/1979 | Honda | 415/119 |
| 4,448,573 | 5/1984 | Franz | 415/206 |
| 4,548,548 | 10/1985 | Gray, III et al. . | |
| 4,971,143 | 11/1990 | Hogan | 165/122 |
| 5,409,352 | 4/1995 | Lin | 415/177 |

FOREIGN PATENT DOCUMENTS

| | | |
|---|---|---|
| 2 647 191 | 11/1990 | France . |
| 43 05 928 | 9/1994 | Germany . |

*Primary Examiner*—Edward K. Look
*Assistant Examiner*—Rhonda Barton

[57] ABSTRACT

The fan housing of an axial fan having a flow resistance such as a coil or grille in a closely spaced relationship is provided on its discharge side with a plurality of circumferentially spaced, radially extending vanes. The vanes act as a radial diffuser in coacting with the rotational/irregular flow in the fan orifice to radially direct the flow and distribute it over the face of the flow resistance.

5 Claims, 3 Drawing Sheets

DISCHARGE VANES FOR AXIAL FANS

BACKGROUND OF THE INVENTION

Conventional axial fans such as propeller fans normally have a fan housing which either fully or partially encloses the fan blade tips. Such fans are commonly used in HVAC applications such as condensing units. In these applications the fan basically blows air through a flow resistance such as a condenser coil. When such a fan is used in the condenser side of an air conditioning system, the fan usually has condensate slinger structure associated therewith such that collected condensate is slung into the fan flow and onto the condenser coil. Problems associated with axial fans having conventional housings include: rotational/irregular flow in the region enclosed by the housing and coil which interacts with the blade tips thereby generating noise; turbulent flow leaking into the blade passage and generating noise; and inefficient distribution of air to the coil due to turbulent/rotational flow.

SUMMARY OF THE INVENTION

Radial vanes are provided on the discharge side of the fan housing of an axial fan. The blades of the fan may be shrouded or have free tips. The radial vanes are located radially outward of the blade tips and, preferably, they extend the depth of the blades and at least a short distance beyond the blades. The radial vanes act as a radial diffuser and improve fan performance by breaking up the rotational flow and thereby reducing the blade pass noise since less turbulent flow is interacting with the blade tips. Additionally, the vanes aid in the distribution of condensate over a condenser coil.

It is an object of this invention to reduce blade passage noise in an axial fan.

It is another object of this invention to facilitate condensate distribution on the condenser coil.

It is an additional object of this invention to improve air distribution and fan performance in a fan coil unit. These objects, and others as will become apparent hereinafter, are accomplished by the present invention.

Basically, air flow from an axial fan having a flow resistance downstream thereof is guided by circumferentially spaced radial guide vanes which act as a radial diffuser such that the rotational flow interacting with the fan blade tips is broken up thereby reducing blade passage noise and condensate entrained in the flow is distributed over the condenser coil.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
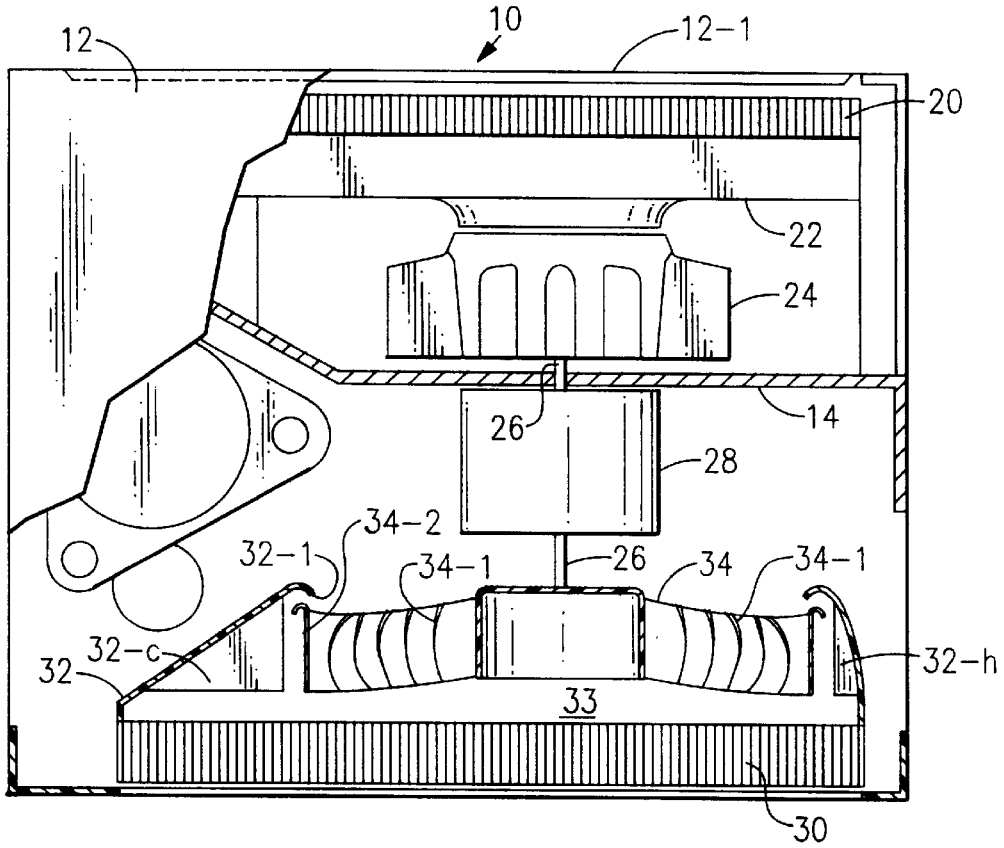
FIG. 1 is a partially cutaway and sectioned view of a room air conditioner employing the present invention.

In FIG. 1, the numeral 10 generally designates a room air conditioner employing the present invention. As is conventional, room air conditioner 10 has a housing 12 which may be located in a window or through the wall sleeve. Air conditioner housing 12 is divided by partition or barrier 14 into an evaporator or inside section and a condenser or outside section which are each, in turn, divided into a suction and a discharge section relative to the fans located therein. Housing 12 includes inlet grille 12-1 which, when air conditioner 10 is installed, faces the interior of a room to be cooled. Evaporator 20 is located directly behind inlet grille 12-1 and is mounted within evaporator shroud or housing 22.

Housing 22 has a central rear opening connected to the inlet of evaporator fan 24. Fan 24 is driven by motor 28 via shaft 26 which passes through and is sealingly supported by partition 14. Evaporator fan 24 discharges into the room to be cooled via louvers (not illustrated). Condenser 30 is located in housing 12 with its discharge side facing the outside. Condenser fan housing 32 is connected to condenser 30 and the interior of housing 12 such that a fan chamber 33 containing at least a portion of the moving portion of condenser fan 34 is formed. Fan housing 32 includes an inlet orifice 32-1. Fan 34 is of the axial, propeller type and is illustrated as located entirely in the fan chamber 33 and is connected to motor 28 via shaft 26 such that both of fans 24 and 34 are commonly driven. Fan 34 has blades 34-1 and a shroud 34-2. A portion of fan 34 may extend into orifice 32-1.

In operation, motor 28 commonly drives evaporator fan 24 and condenser fan 34. Evaporator fan 24 draws air from the room to be cooled with the air serially passing through inlet grille 12-1, evaporator 20 which causes the air to be cooled, fan 24 and louvers (not illustrated), then back into the room. Condenser fan 34 draws outside air into housing 12 via an inlet grille (not illustrated) and the air serially passes through fan 34, and condenser 30 rejecting heat from the condenser and passing to the outside.

Figure 2:
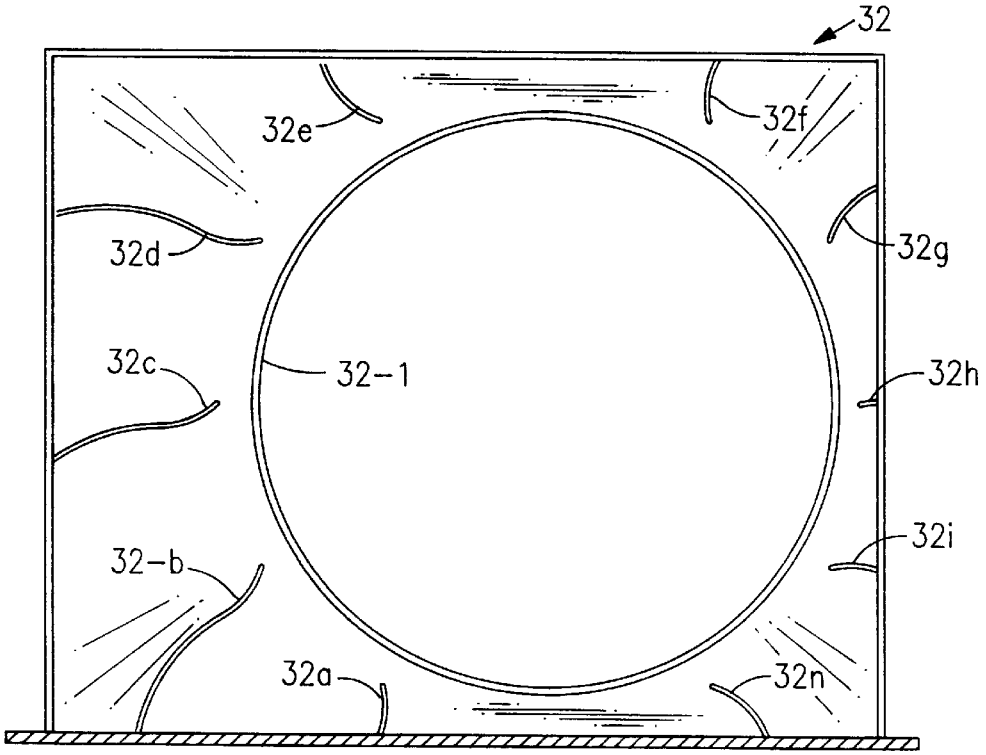
FIG. 2 is a discharge side view of the fan housing of FIG. 1.

The structure and operation described above is generally conventional and, as such, the flow coming off the condenser fan 34 would tend to be rotational/irregular, with a resultant inefficient distribution of air and any entrained condensate over the condenser coil 30. The present invention adds radial vanes 32-*a*, 32-*b*, . . . 32-*n* which, as best shown is FIG. 1 are of varying radial extent which increases in a downstream direction. As best shown in FIG. 2, vanes 32-*a* to 32-*n* are circumferentially spaced about inlet orifice 32-1. Inlet orifice 32-1 is located on the suction side of fan housing 32 but is not centered in fan housing 32 due to the necessity of locating other components in housing 12. Accordingly, the inlet orifice 32-1 and fan 34 are not centered on the condenser coil 30. The spacing of vanes 32-*a* to 32-*n* is not uniform, at least in the top and bottom of fan housing 32, since their absence and/or reduced length permits the room air conditioner 10 to be of a reduced height. The vanes 32-*a* to 32-*n* are at least axially coextensive with the blades 34-1 of fan 34 and radially extend to the periphery of fan housing 32. The vanes 32-*a* to 32-*n* are of varying lengths due to the absence of symmetry. Vanes 32-*a* to 32-*n* are of a shallow S-shape and, preferably, axially extend a short distance beyond the downstream side of blades 34-1 of fan 34.

The downstream resistance provided by the condenser coil 30 tends to provide a radial component to the discharge from fan 34 with a rotational flow superimposed thereon.

Vanes 32-*a* to 32-*n* coact with the radial portion of the flow to remove the rotational component and to direct the radial portion of the flow to the periphery of the condenser coil 30 thereby providing a more uniform air and entrained condensate distribution over the coil and reducing blade passage noise.

Figure 3:
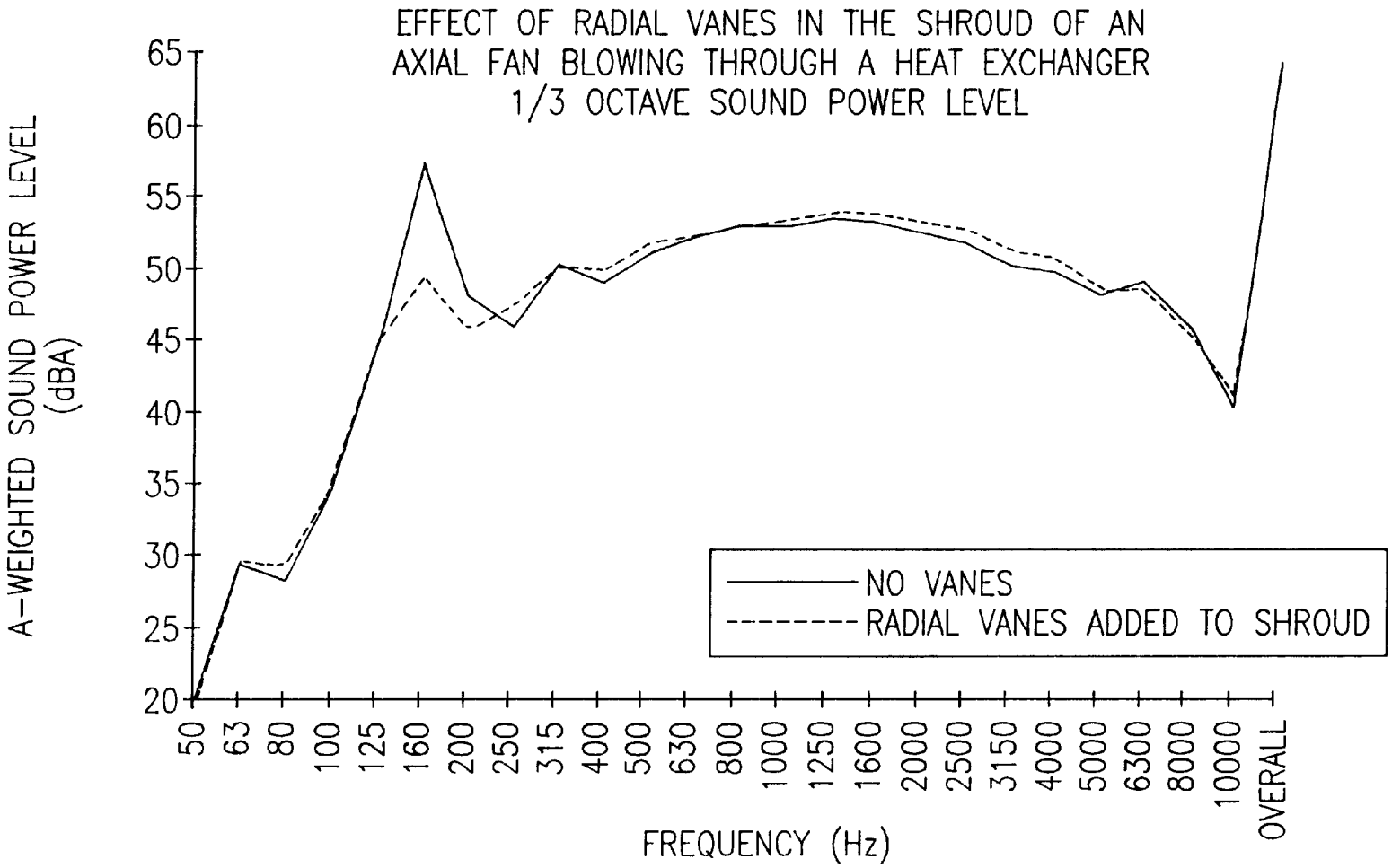
FIG. 3 is a graph of A-weighted sound power level (dBA) vs frequency (Hz) for a shrouded axial fan blowing through a heat exchanger with and without radial vanes.

Referring now to FIG. 3, the graph shows the effects, relative to sound, of the adding of radial vanes 32*a* to 32*n* in the shroud of an axial fan blowing through a heat exchanger/condenser at ⅓ octave sound power level. The output was 420 cfm at a motor speed of 1400 rpm. Overall the addition of vanes 32*a* to 32*n* to the shroud reduced the noise from 64.2 dBA to 63.8 dBA. It will be noted, however, that most of the reduction was in the 125 to 225 Hz ranges.

Figure 4:
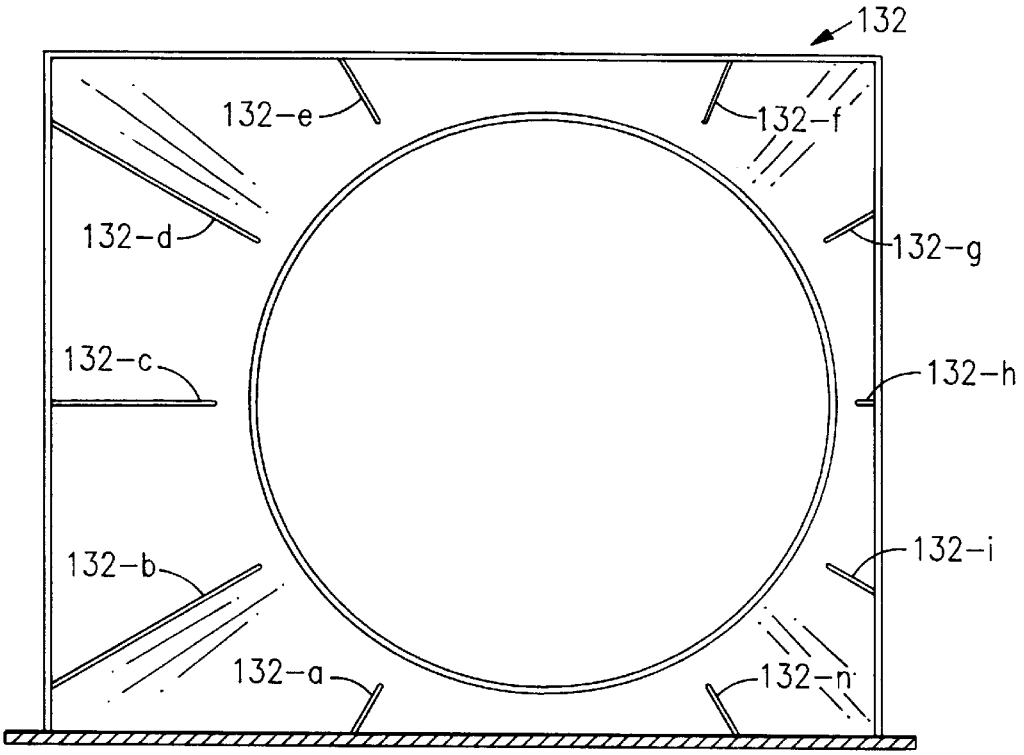
FIG. 4 is a discharge side view of a first modified fan housing.

Referring now to FIG. 4, fan housing 132 differs from fan housing 32 in that radial vanes 132-*a* to 132-*n* are straight rather than S-shaped. Vanes 132-*a* to 132-*n* coact with the flow to direct it over the face of the coil of the condenser.

Figure 5:
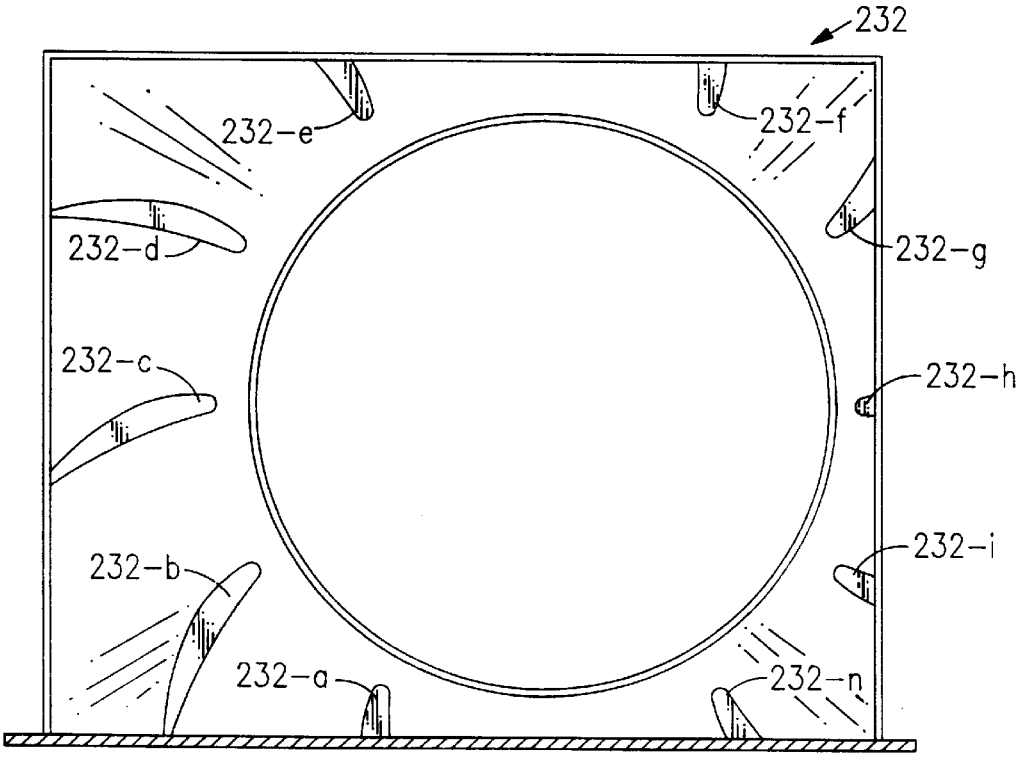
FIG. 5 is a discharge side view of a second modified fan housing.

Referring now to FIG. 5, the fan housing 232 differs from fan housing 32 and 132 in that radial vanes 232-*a* to 232-*b* are airfoil shaped. Vanes 232-*a* to 232-*n* coact with the flow to direct it over the face of the coil of the condenser.

It follows that all of the embodiments of the present invention act in basically the same fashion. The vanes coact with the rotational component of radial flow to direct the flow radially and thereby over the face of the coil of the condenser. The vanes can be of uniform or varying spacing and can be of any shape conducive to the low loss directing of the fluid flow.

Although preferred embodiments of the present invention have been illustrated and described, other changes will occur to those skilled in the art. For example, the present invention can be used where the downstream loss or resistance is a grille rather than a coil. It is therefore intended that the scope of the present invention is to be limited only by the scope of the appended claims.

What is claimed is:

1. A fan housing having a suction side and a discharge side;

an inlet orifice located in said fan housing;

a shrouded axial fan inserted at least partially through said inlet orifice into said fan housing and having a plurality of blades;

a plurality of circumferentially spaced, radially extending vanes located within said fan housing on said discharge side of said inlet orifice, radially spaced from said fan and at least partially axially coextensive with said blades within said fan housing;

said fan housing being radially spaced from said blades by a distance which increases in a downstream direction such that said vanes are of an increasing radial extent in a downstream direction; and a flow resistance located downstream of and axially spaced from said axial fan and said vanes.

2. The fan housing of claim 1 wherein said vanes are asymmetrical.

3. The fan housing of claim 1 wherein said vanes are straight.

4. The fan housing of claim 1 wherein said vanes are airfoil shaped.

5. The fan housing of claim 1 wherein said vanes extend to the periphery of said fan housing.

* * * * *